US007594361B2

(12) United States Patent
Tragant Ruano

(10) Patent No.: US 7,594,361 B2
(45) Date of Patent: Sep. 29, 2009

(54) MODULAR BUILDING SYSTEM AND METHOD FOR LEVEL ASSEMBLING OF PREFABRICATED BUILDING MODULES

(75) Inventor: José Tragant Ruano, Barcelona (ES)

(73) Assignee: Compact — Habit S.L., Barcelona (ES)

( * ) Notice: Subject to any disclaimer, the term of this patent is extended or adjusted under 35 U.S.C. 154(b) by 325 days.

(21) Appl. No.: 11/366,024

(22) Filed: Mar. 2, 2006

(65) Prior Publication Data

US 2006/0196132 A1 Sep. 7, 2006

(30) Foreign Application Priority Data

Mar. 3, 2005 (ES) ..... 200500490

(51) Int. Cl.
*E04H 1/00* (2006.01)
*E04B 2/00* (2006.01)

(52) U.S. Cl. ..... 52/79.9; 52/79.13; 52/582.1; 220/1.5; 220/4.27

(58) Field of Classification Search ..... 52/79.1, 52/79.9, 79.5, 167.7, 167.9, 424, 747.12, 52/582.1, 79.13, 745.2; 220/1.5, 4.33, 4.2, 220/4.26

See application file for complete search history.

(56) References Cited

U.S. PATENT DOCUMENTS 3,377,755 A * 4/1968 Meuli et al. ..... 52/79.13
3,564,795 A * 2/1971 Henton ..... 52/79.2
3,690,077 A * 9/1972 Dalgliesh et al. ..... 52/79.8
3,749,273 A * 7/1973 Wreghitt et al. ..... 220/1.5
3,824,750 A * 7/1974 Antoniou ..... 52/79.13
3,871,146 A * 3/1975 Hamy ..... 52/79.7
3,907,147 A * 9/1975 Goobeck ..... 220/1.5
3,921,240 A * 11/1975 Fyfe ..... 14/16
3,990,193 A * 11/1976 Ray et al. ..... 52/79.11
4,186,841 A * 2/1980 Buckley et al. ..... 220/6
4,435,927 A * 3/1984 Umezu et al. ..... 52/79.13
4,599,829 A * 7/1986 DiMartino, Sr. ..... 52/79.7
4,694,621 A * 9/1987 Locke ..... 52/79.13
4,813,542 A * 3/1989 Thompson et al. ..... 206/504
4,942,975 A * 7/1990 Capron et al. ..... 220/23.4

(Continued)

FOREIGN PATENT DOCUMENTS

DE 23 26 277 A1 12/1973

(Continued)

*Primary Examiner*—Brian E Glessner
(74) *Attorney, Agent, or Firm*—Locke Lord Bissell & Liddell LLP; Brandon T. Schurter

(57) ABSTRACT

The modular building system consists of building modules (1) in high resistance, reinforced concrete, to be stacked vertically and placed side-by-side in the construction of preferably residential buildings. Each module (1) forms a monolithic structure or consists of a steel frame (103) and panels (102), with walls, ceiling and floor. These modules (1) include positioning devices (2 and 3) for stacking purposes; side connection elements (5 and 6) between the modules (1); and/or horizontal and vertical tightening bands (104 and 105). These modules are leveled by using leveling sheets and/or non-retraction mortar and/or a method with jacks (108) and tubular sections (109) filled with non-retraction mortar (193) until it sets and the jacks (108) are removed. Each building module (1) includes all the accessories and finishing elements of a home, such as facades, windows, utilities, furniture and interior equipment considered useful.

5 Claims, 13 Drawing Sheets

U.S. PATENT DOCUMENTS

| | | | | | |
|---|---|---|---|---|---|
| 5,031,794 | A * | 7/1991 | Wezenberg | 220/4.28 |
| 5,396,742 | A * | 3/1995 | Romig et al. | 52/79.9 |
| 5,678,715 | A * | 10/1997 | Sjostedt et al. | 220/1.5 |
| 5,706,614 | A * | 1/1998 | Wiley et al. | 52/79.1 |
| 5,755,063 | A * | 5/1998 | Ohnishi et al. | 52/79.8 |
| 6,109,469 | A * | 8/2000 | Clive-Smith | 220/1.5 |
| 6,625,940 | B2 * | 9/2003 | Sanger | 52/125.4 |
| 6,871,453 | B2 * | 3/2005 | Locke | 52/79.13 |
| 2007/0271857 | A1 * | 11/2007 | Heather et al. | 52/79.9 |

FOREIGN PATENT DOCUMENTS

| | | | |
|---|---|---|---|
| EP | 962603 | A | 12/1999 |
| EP | 1184521 | A | 3/2002 |
| FR | 2430487 | A | 2/1980 |
| GB | 1476959 | A | 6/1977 |
| WO | WO 97/38179 | A | 10/1997 |
| WO | WO 98/40573 | A | 9/1998 |

* cited by examiner

Fig. 2
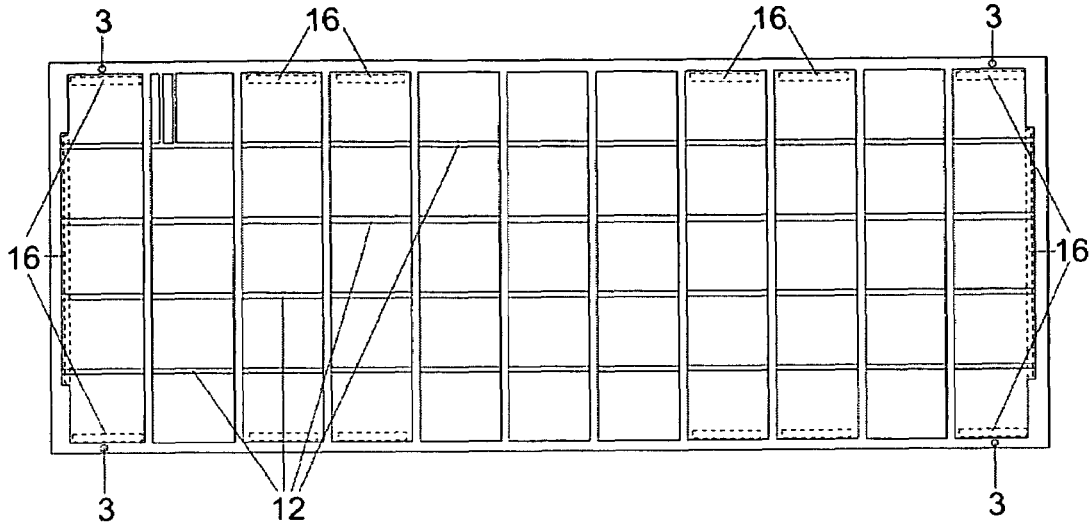
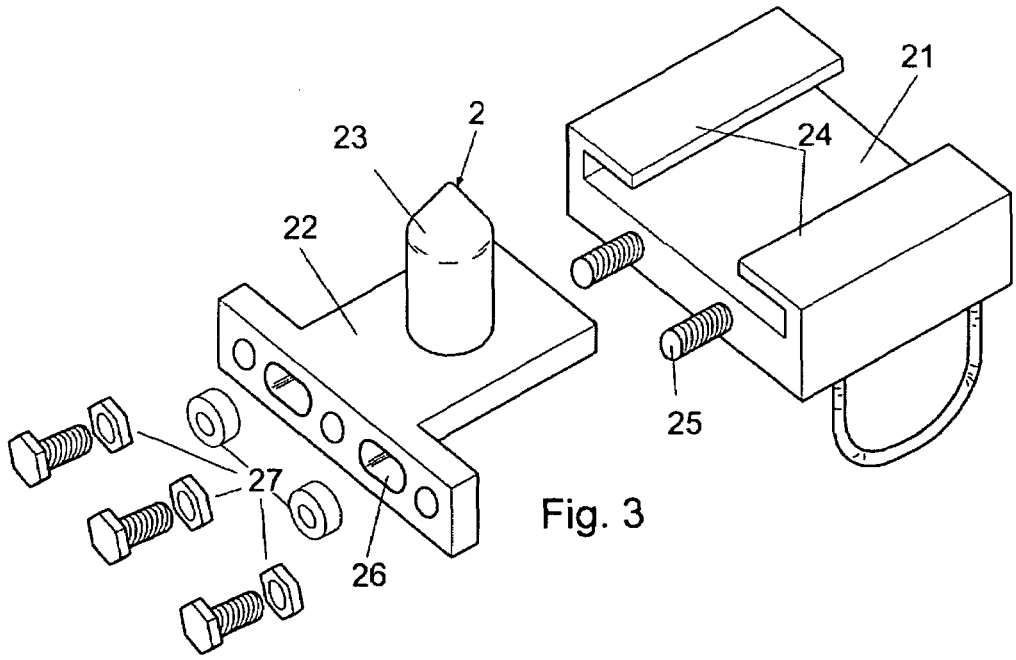
Fig. 3

MODULAR BUILDING SYSTEM AND METHOD FOR LEVEL ASSEMBLING OF PREFABRICATED BUILDING MODULES

PURPOSE OF THE INVENTION

This invention refers to a modular building system and a method for level assembling of prefabricated building modules, to be stacked vertically and side-by-side in order to construct a building for residential or other purposes.

BACKGROUND TO THE INVENTION

To reduce building costs, without lowering quality, by replacing the traditional method of placing materials with on-site, prefabricated modules, has been a concern for some time.

Existing prefabricated modules may be the size of a small home. However, building with this type of prefabricated modules, by placing them side-by-side and stacking them, causes different problems, such as the lack of stability in the event of side stress owing to earthquakes, wind or the settling or movement of the building. This means that at present, buildings made with these types of modules are made up to a maximum height of 3 storeys, or in other words, three modules.

There may also be small building errors in these modules, meaning that the side and horizontal surfaces may not be perfectly perpendicular. The accumulation of errors when stacking multiple modules could be fatal for the stability of the building.

Buildings currently made with this type of modules require expensive expansion joints, which apart from increasing the construction cost, also complicate building significantly.

These modules use prefabricated elements, such as walls made outside the factory and assembled frames, ready to be fitted with other elements at the building site, such as floors or ceilings. However, on-site work is still significant, as adjustment and assembly operations are considerable and difficult to solve.

DESCRIPTION OF THE INVENTION

The modular building system and method of this invention consists of a series of technical features enabling quick and economic building, with the simple assembly of modules, which can also be dismantled in the event that the building is to be removed from the site where it was built.

The system consists firstly of a series of high-resistance, reinforced concrete building modules.

Each module can correspond to the space of a home or whatever it is planned to be used for, with the ceiling, the walls and floor, together with the means to place balconies and adjacent passageways. These modules are joined on the building site, using positioning elements to enable them to be vertically stacked. To do this, vertical supports are used so that each module rests on the support under it. There are also side-joining elements to join the adjacent modules sideways and fastening elements to place the modules using a crane.

Each module includes all the accessories and finishing element of the home, including facades, windows, services, furniture and all interior equipment considered useful. This construction is made in the factory, at a distance from its final position. Using this system can reduce costs, as all finishing elements of the home are standard manufactured at the factory, thereby avoiding on-site work. Also, as the building modules are supplied pre-assembled, it is only necessary to prepare the building foundations and the connections for water, light, telephone and other utilities. The module has holes in both the ceiling and the floor to pass the conduits of these utilities.

The module consists of a series of reinforcement ribs, which surround the module transversely. These ribs wrap around the walls, floor and ceiling in the form of perimeter trusses and are used to provide sufficient resistance for the required torsional rigidity of the stacked modules. At the same time, the module also consists of a series of longitudinal ribs, which are positioned on the floor to support loads. The module is completed, from a constructional point of view, with reinforcements or braces on the edges and openings, to pass through water and light utilities, or staircases and similar.

For stacking purposes, each module has positioning devices placed on the upper side corners. These positioning devices fit in bushings placed in matching positions on the lower side of the adjacent module for easy placement with a crane.

The positioning device consists of a cylindrical rod, with a free end finishing in a pointed cone, and means to adjust its position on a horizontal place during manufacture and prior to assembling the module immediately above it. The positioning device therefore has an embedded plate to fasten a flat bar joined to the rod. This embedded plate has rails to loosely assemble the flat bar of the rod, and screws to fasten the flat bar and rod once they are positioned correctly, by means of the corresponding nuts, and screws to move and tighten them correctly.

The receiving bushing consists of an inner bushing and an outer or fitted bushing, with an elastic element between them, such as neoprene, to absorb knocks and/or movements while assembling the modules and to cushion the movement of the module while it slides over the wall of the positioning cone.

As we mentioned previously, the modules are stacked one on top of the other, with the lower modules supporting the weight of those on top. For correct stacking, each module has supports for vertical loads on its upper part, which match vertical reinforcement ribs to transmit stress as if it were a load-bearing wall.

Each support consists of an embedded plate on which there is a block made in an elastic material such as neoprene. The block has a central safety bolt which works in the extreme case of the accidental wear of the block as a transmitter of vertical loads. This vertical support breaks the acoustic bridge owing to the aforementioned neoprene material. Contact of the vertical support with the base of the upper module is done directly. In the event of a level difference and contact cannot be made, one or more levelling or supplementary sheets and/or non-retraction mortar is placed. These sheets are adhered using resin on the upper module to avoid movements.

Until now, it has been considered that building consists of stacking modules and fastening them by gravity. However, a typical building consists of several of these module columns together to build several storeys. In this situation, the problem arises that the columns of modules can sway as a result of wind or an earthquake, and they must there be linked sideways. To do this, the modules include plates embedded into the upper side edge, placed horizontally and matching the plates located in the adjacent module. There is a connection plate between these plates, with mounting holes to pass through lock screws to ensure the join. These screws are also blocked by toothed washers so that they are completely immobile. As an additional safety measure, the embedded plates have a projecting pin placed in a corresponding mounting hole of the connection plate. This connection plate also has neoprene blocks or sheets to absorb vertical stress and break the acoustic bridge. This side connection enables the columns of modules to sway simultaneously, and is even flexible regarding the vertical cutting stress between the columns of modules.

The modules have fastenings to hold, lift and place them with cranes. There are fastening in the upper part of the module, placed in a regular manner so that when the module is lifted with a crane, it is not subject to twisting or bending stress, which may alter the installations and accessories placed. The modules can be lifted by a medium transport frame hooked to the crane cable. It has also been designed for these fastenings to be removed when they are not in use. To do this, the fastenings are screwed to the embedded plates, which are the side joint.

To absorb stress in the horizontal plane between a module and the one immediately above or below it, the modules have common buffers, some on the floor and some on the ceiling, so that in the event of movement on the horizontal plane, the buffers on the floor will knock against the buffers on the ceiling, and this contact stops this movement. There are common buffers against longitudinal and transversal movements.

At points of possible contact through the interference of two adjacent modules, neoprene separators are placed, which prevent an acoustic bridge from forming, which could mean noise transmission from one module to another.

In one of the manufacturing examples of the invention, it is planned that the modular system consists of:

- the building modules, which define the prismatic containers which are placed side-by-side on each of the floors, and which are stacked in the following floors of the building.
- A horizontal mechanical tightening device, which horizontally compresses the building modules placed side-by-side and forming each of the floors of the building, and
- a vertical mechanical tightening device, which vertically compresses the building modules stacked vertically in the building.

The aforementioned building modules simultaneously form the structure of the building and the walls of the rooms, so that safety and stability of the building is guaranteed during building, together with acoustic insulation, but cutting frequencies in the acoustic, air or impact transmission frequencies.

In this alternative manufacturing method, the building modules consist of at least, four prefabricated, highly resistant pre-stressed concrete panels, assembled mechanically and provided with a steel frame on the edges, which guarantees the orthogonality or perpendicularity between the horizontal panels and the vertical panels of the same building module.

The incorporation of the aforementioned steel frame in the modules prevents the accumulation of angular difference errors when one or more building modules are stacked.

This alternative provides a characteristic, which is determined by the incorporation of horizontal and vertical tightening devices producing a compression effect on the modules. This enables the building to become very monolithic as a whole, without losing the elasticity required in all buildings.

The horizontal mechanical tightening device consists of horizontal bands, which are placed between modules corresponding to consecutive floors, as the building is built. These bands have threaded terminals on the end for assembly purposes. On each of these terminals there is a slip-proof material plate, a steel plate and a lock nut.

When the nuts located at each end of the aforementioned bands are tightened, the slip-proof plate and the steel plate work against the end module or a row or rows of horizontal modules to be compressed, providing stability and safety required to continue the building by placing the corresponding modules of the floor immediately above.

The vertical mechanical tightening device also consists of galvanized steel bands with protection casing. These bands are placed vertically between the successive columns of stacked modules. These vertical bands have threaded end terminals for assembly in each of these terminals of an slip-proof material plate, a steel plate and a lock nut. The nuts corresponding to these vertical bands are tightened once the structure is finished, that is, once the required height has been reached.

The horizontal and vertical bands can be composed of steel cables or threaded steel rods. The tension to add to the bands is calculated depending on the different conditions of height, wind or risk of earthquakes.

In any event, the horizontal and vertical bands form latticework or mesh, which applies compression both in the horizontal and vertical direction to the different building modules, providing a high monolithic capacity to the building, without losing the required elasticity of the building at any time. The aforementioned horizontal and vertical bands provide a "packaging" or "compressive linking" effect meaning that the set of modules or units becomes a single building.

This system has further advantages such as the possibility of eliminating expansion joints, simply breaking off the horizontal bands about every 50 metres.

Apart from the metal frames of the building modules, this manufacturing method also foresees the incorporation of suitable brackets to fasten annexe metal structures or to place a cantilever concrete module.

It has also been foreseen that the prefabricated panels making up the horizontal and vertical surfaces of the building modules can be continuous or can have openings for windows, balconies, staircases or other passageways.

The level assembly method of prefabricated building modules means that assembly of stacked modules is quick and simple, so that they are perfectly level and at the required height, and each of said modules is at the same height as the side modules forming the same floor. Another objective of the invention is to ensure a uniform load distribution between the modules and to avoid concentrated loads.

To do this, the method consists of the following steps or phases:

- positioning hydraulic jacks on the lower, previously levelled, prefabricated module. These jacks are connected by means of ducts to a hydraulic power system,
- placing inflatable tubular sections on the lower prefabricated module. These sections are made in a flexible material and are connected by means of hoses to non-retraction mortar injection device,
- resting an upper prefabricated module on hydraulic jacks.
- levelling and adjusting the height of the upper prefabricated module using the four jacks and the hydraulic power system,
- inflating the tubular sections by injecting non-retraction mortar so that this section adapts to the interstitial space between the upper and lower modules.,
- maintaining the upper prefabricated module resting on hydraulic jacks while the mortar injected into the tubular sections sets and finally,
- removing the hydraulic jacks.

The initial assembly of the upper module on the hydraulic jacks enables it to be perfectly level and its positioning at a suitable height so that it is perfectly aligned with the prefabricated modules placed at the side, and which together form the same floor of the building.

Also, once the upper prefabricated module is positioned correctly using the hydraulic jacks, the inflation or filling of tubular sections with non-retraction mortar means that the non-retraction mortar fills the interstitial space between the upper and lower modules, adapting to any possible irregularities of the modules. This means that once the mortar has set and the hydraulic jacks have been removed, the upper prefabricated module will remain in the same position. The sections containing the set mortar guarantee an even transmission and distribution of loads of the upper module to the lower module.

To level the upper prefabricated module using hydraulic jacks, it is foreseen that these hydraulic jacks will be assembled in an area near the corners of the lower module.

DESCRIPTION OF THE FIGURES.

To complement the description of the invention and in order to better understand its characteristics, a set of drawings is attached to this descriptive report, which represent the following in an illustrative and non-limiting fashion:

FIG. 2 is a lower view of a module.

FIG. 3 is breakdown of the parts of a positioning device.

PREFERENTIAL MANUFACTURE OF THE INVENTION

Figure 1:
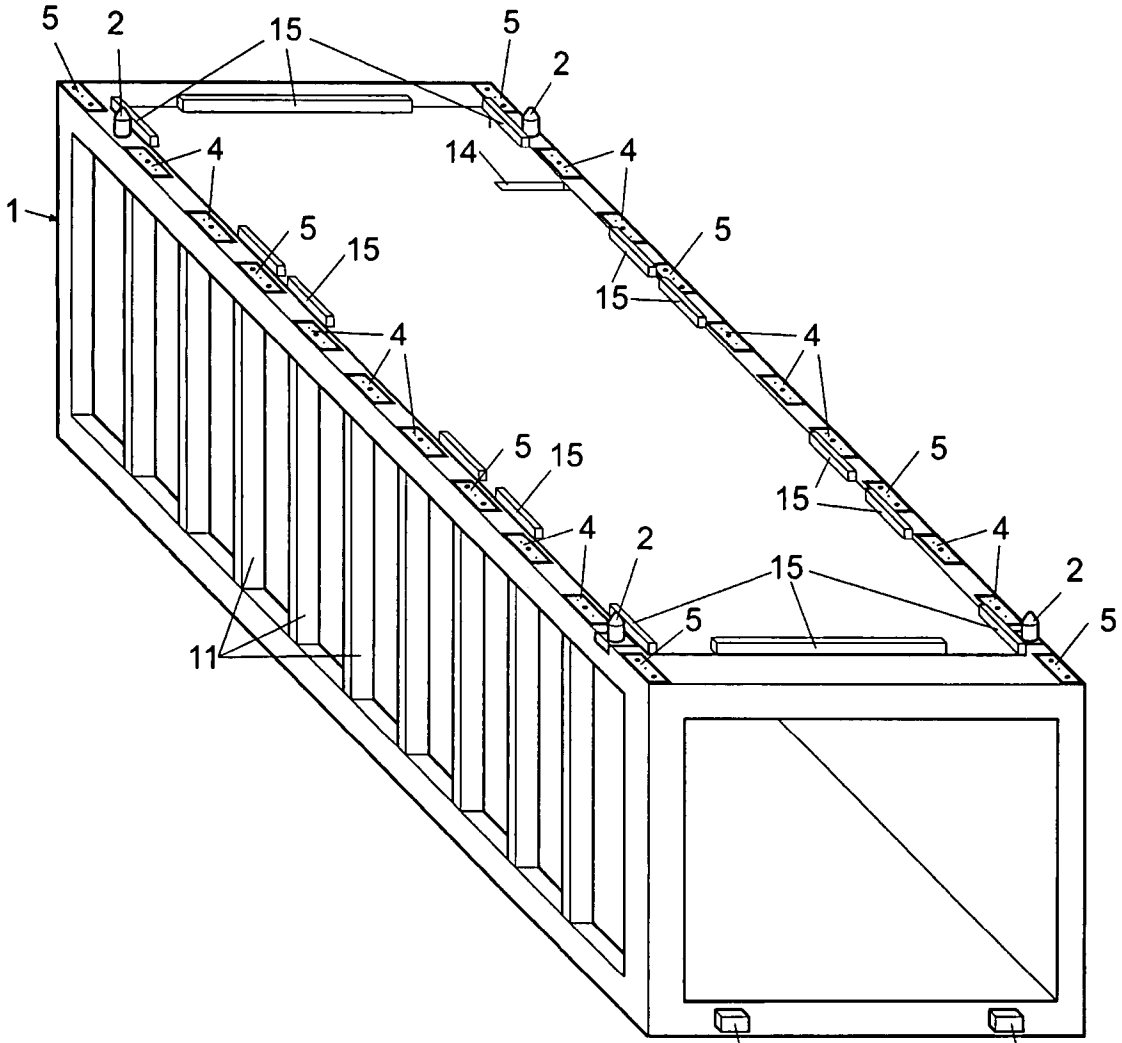
FIG. 1 is a perspective view of a module.
Figure 4:
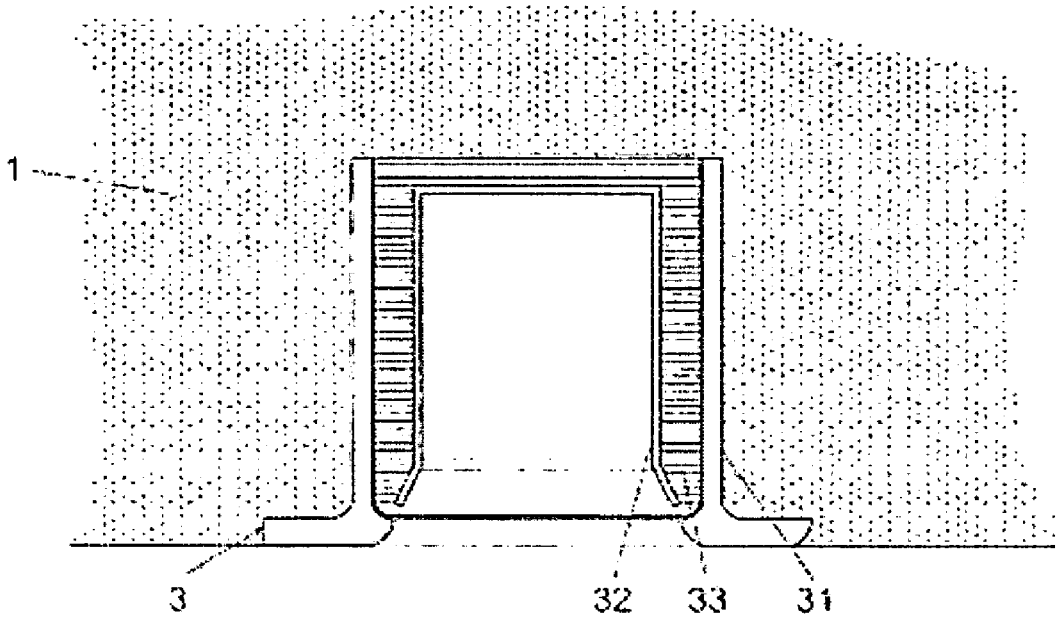
FIG. 4 is an elevation section view of a bushing of the positioning device.
Figure 5:
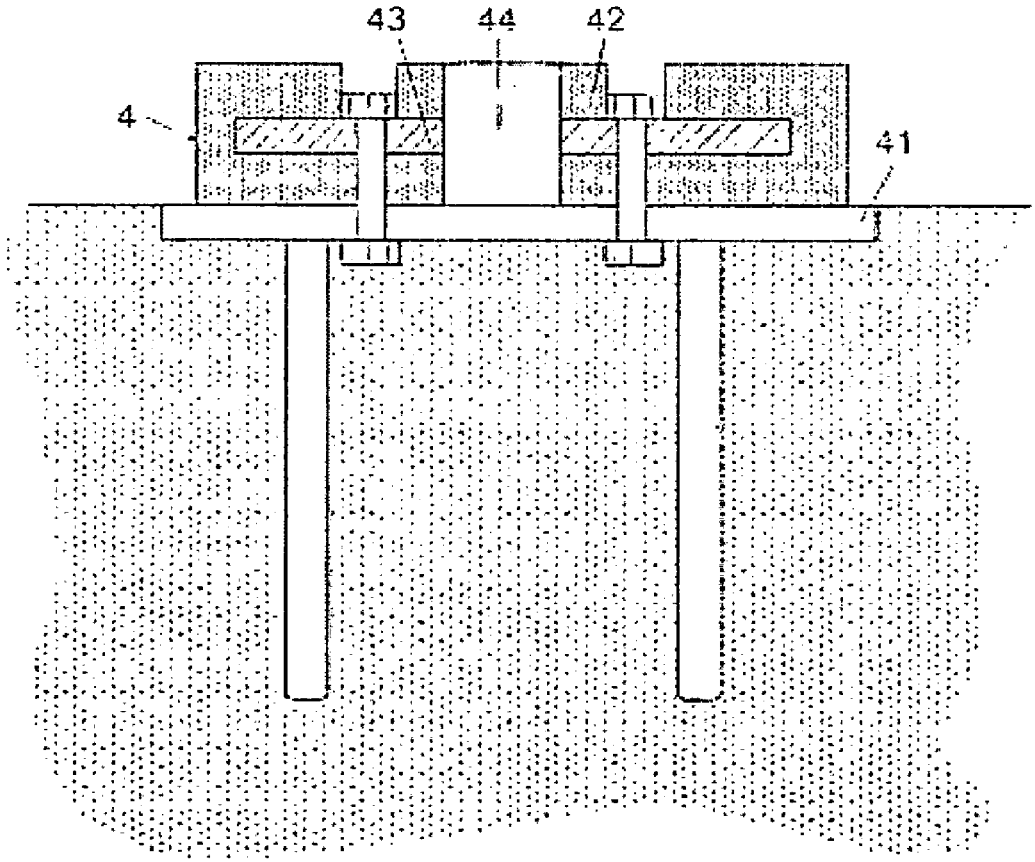
FIG. 5 is an elevation view of a bracket support of one module on another.
Figure 6:
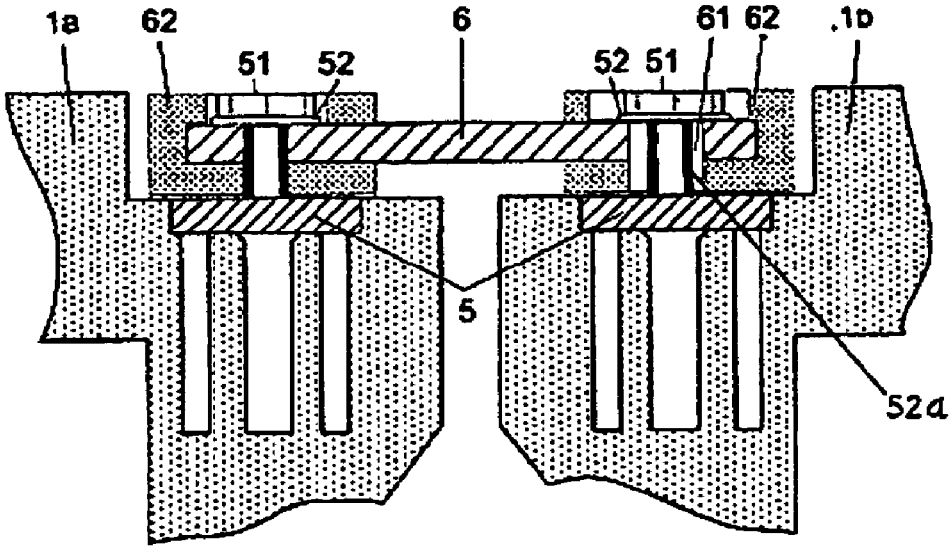
FIG. 6 is an elevation view of a lateral joint between two adjacent modules.
Figure 7:
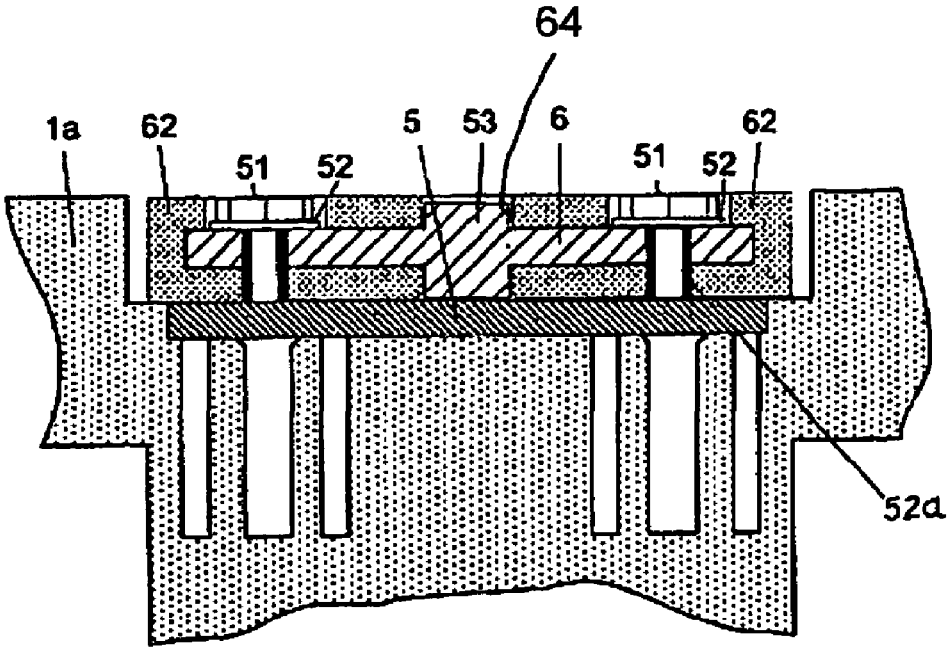
FIG. 7 is a cross section view of a side joint embedded plate between two adjacent modules.
Figure 8:
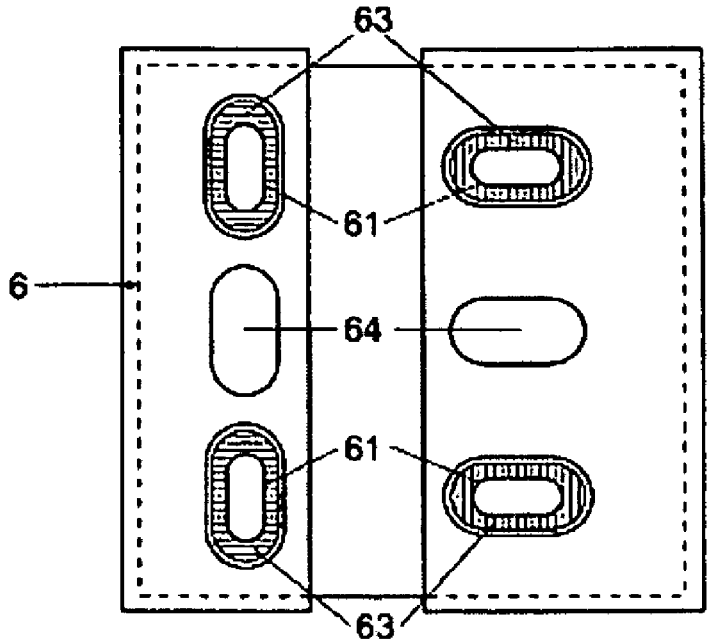
FIG. 8 is a ground view of the connection plate of the above side joint.
Figure 9:
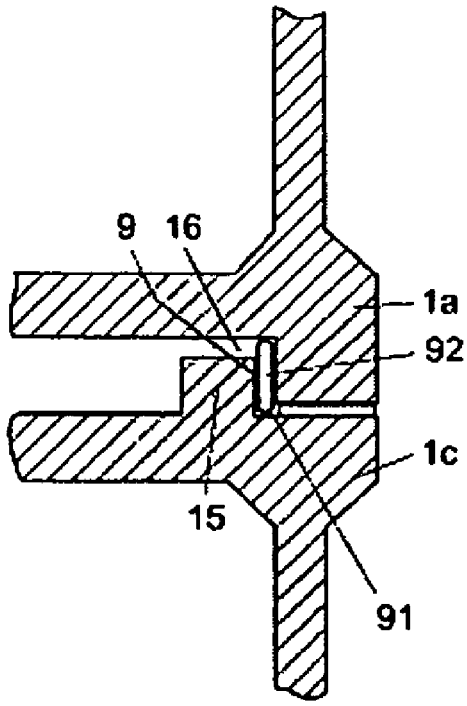
FIG. 9 is a cross section of the stacking fastening buffer and the horizontal stress reinforcement filling placed between two stacked modules.
Figure 10:
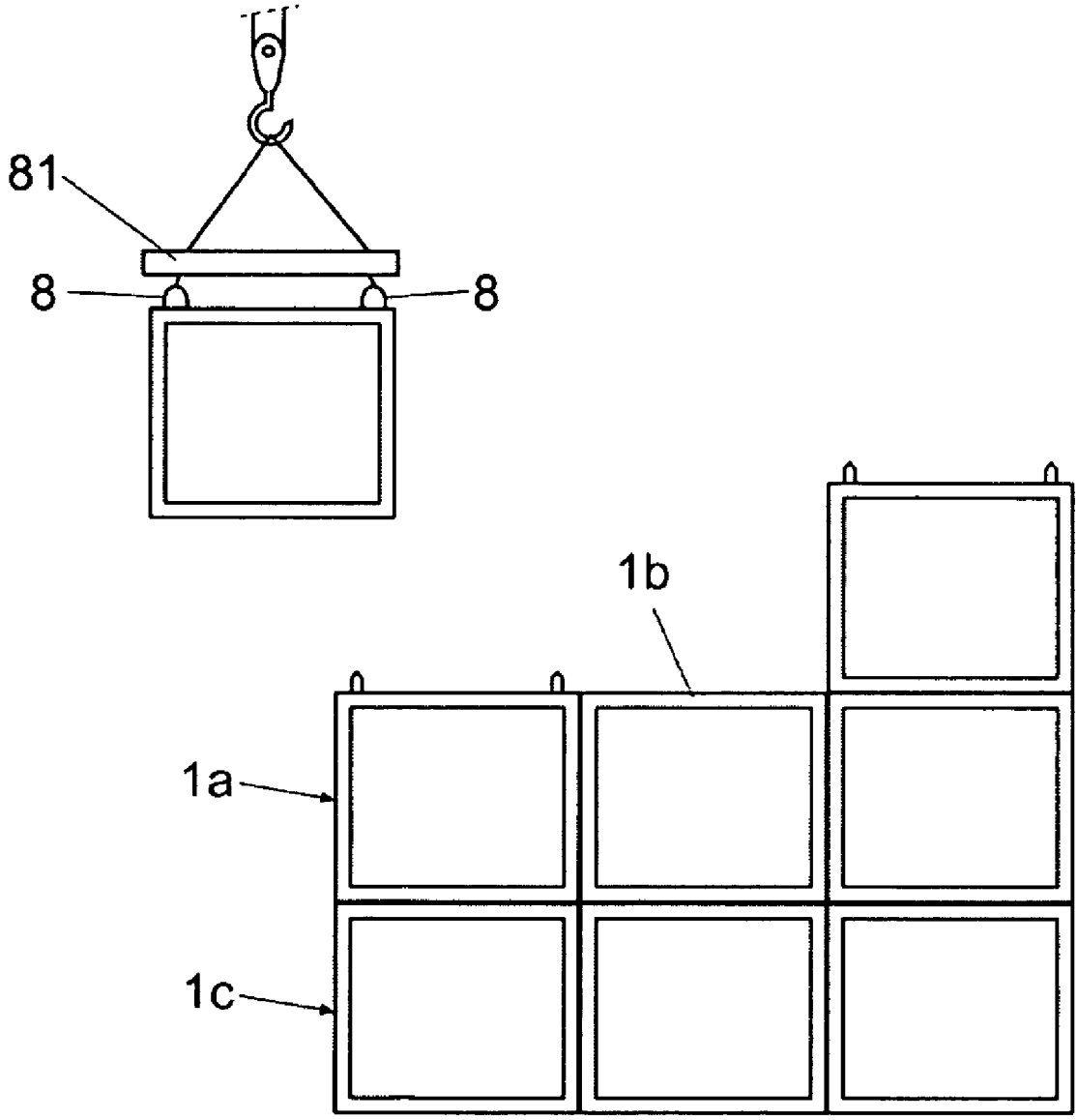
FIG. 10 is a schematic drawing of a building method using the modular building system.
Figure 11:
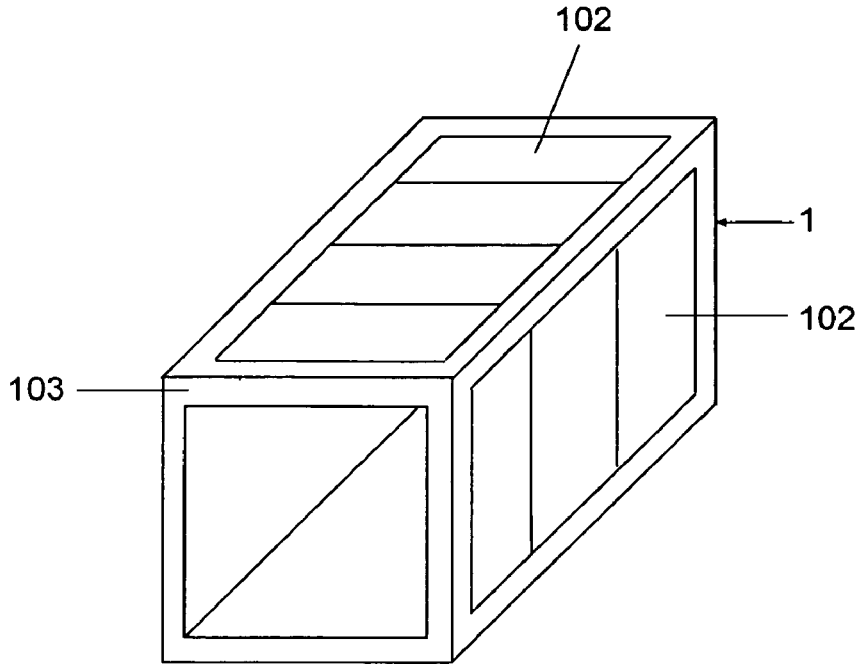
FIG. 11 is a schematic perspective drawing of an alternative example of a building module consisting of a steel frame and prefabricated panels.

As can be seen in the aforementioned figures, the modular system consists of a series of reinforced concrete building modules (1) to be stacked vertically and placed side-by-side.

In the first example, each module (1) consists of a structure with sidewalls, ceiling and floor, multiple transversally surrounding reinforcement ribs (11) distributed on said longitudinal walls, ceiling and floor, and multiple longitudinal reinforcement ribs (12) placed on the floor.

Inside the module (1) are all the finishing elements, facades, windows and water, electricity, etc. installations required for a home. In the ceiling and floor there are holes (14) to pass the aforementioned utilities. At the same time, the module (1) can have exterior fastenings (13) for external building elements, such as balconies, passageways and others.

Each module (1) has positioning devices (2) placed near the corners of the upper side or ceiling, and bushings (3) placed matching the corners of the lower side, to receive the positioning devices (2) of the module (1) immediately below.

As can be seen in the details of FIG. (3), each positioning device (2) consists of an embedded flat bar (21) for the adjustable assembly and fastening of an L-shaped plate (22), on which a cylindrical rod (23) is fastened, with the free end finishing in a cone point. To enable the aforementioned adjustable assembly, the flat bar (21) has upper rails (24) and side screws (25) and lock nuts. The plate (22) also has a lesser width than the space defined by the rails (24), which enables the side adjustment of the plate (22), and on its vertical wing, it has mounting holes (26) to pass through the screws (25) and holes for the lock screws, thereby fastening the plate (22) in the required position by means of nuts (27) and lock screws.

As can be observed in FIG. (4), the reception bushing (3) of the positioning devices (2) consist of an outer bushing (31) embedded in the module (1) and an inner bushing (32) with elastic filling (33), such as neoprene, between both bushings.

There are a series of vertical supports (4) on the upper edges of the modules, placed matching the transversal reinforcement ribs (11). As can be observed in FIG. (5), each vertical support (4) consists of a plate (41) provided with lower legs 45 to be embedded in the module (1). On the plate there is a block (42) made in an elastic material, such as neoprene or similar, which incorporates a middle metal plate (43). The plate (41) may optionally have a pin (44) which semi-projects through the block (42). In the event that contact is not correct between the upper module and the supports (4) of the lower module, there may be one or more levelling sheets (not shown) between these elements. The levelling sheet is adhered to the upper module (1).

On the top of its sides, the module (1) has a series of embedded plates (5), which are side fastened. The fastening between two modules (1*a* and 1*b*) aligned sideways, consists of a connection plate (6) with mounting holes (61) placed at 90° to pass through fastening screws (51) from the embedded plates (5) of the modules (1*a* and 1*b*). Each screw (51) has a lock washer (52) with a toothed surface to match the surrounding toothed surface (63) of the hole, in a transversal direction. Each screw (51) is covered in an elastic material (52*a*).

The connection plate (6) consists of sheets (62) or blocks in elastic material or neoprene, to absorb the vertical stress and to break the acoustic bridge. Each connection plate (6) would preferably have a safety pin (53) projecting from its upper side, placed in a corresponding mounting hole (64) of the plate (6).

Elevation fastenings (8) can later be screwed into these embedded plates (5), placed longitudinally on both sides of the module (1), and which can be used to lift the module by means of a transport frame (81) and a crane.

Projecting buffers (15) are placed along the edges of the upper side of the module (1) matching spaces (16) on the lower side of the upper adjacent module (1), in order to bear the longitudinal and transversal cutting stress owing to the longitudinal and transversal horizontal movement between both modules (1*a* and 1*c*). Between the buffers (15) and side contact with the module (1), there is filling in the vertical contact areas (9). This filling consists of a flat chamber (91) in elastic material, such as neoprene or rubber, to be pressure filled with a non-retraction mortar (92). This elastic material of the chamber (91) acts as insulation of the acoustic bridge.

In the second case of manufacture of the system, the building modules are defined by prismatic containers consisting of prefabricated panels (102), mechanically assembled and provided with a steel frame (103) on the ends, which ensures perpendicularity between the horizontal panels and the vertical panels of the module (1).

Figure 12:
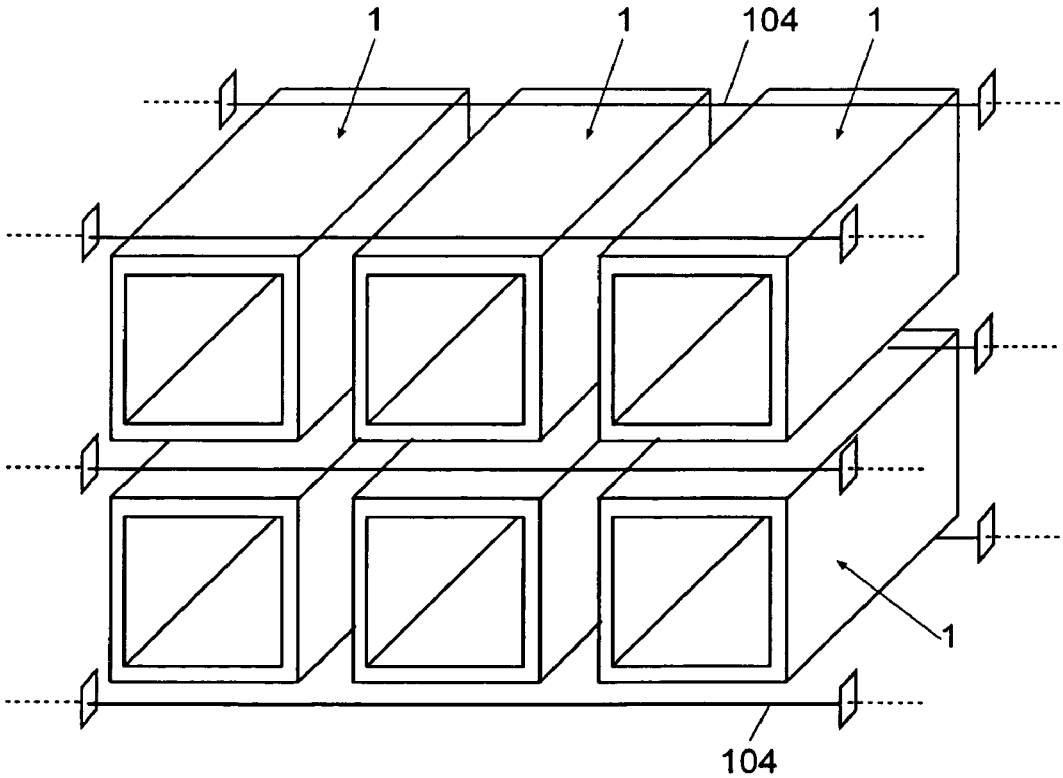
FIG. 12 is a perspective view of several horizontally and vertically aligned modules, which are slightly at a distance, and the horizontal bands used for a compressive joint of the modules in a horizontal direction.

As can be observed in FIG. 12, to construct a building you simply have to align the first row of modules (1) which form the first floor of the building, so that they are placed against each other sideways, although in FIG. 12, these modules (1) are shown slightly at a distance for explanation purposes.

Figure 14:
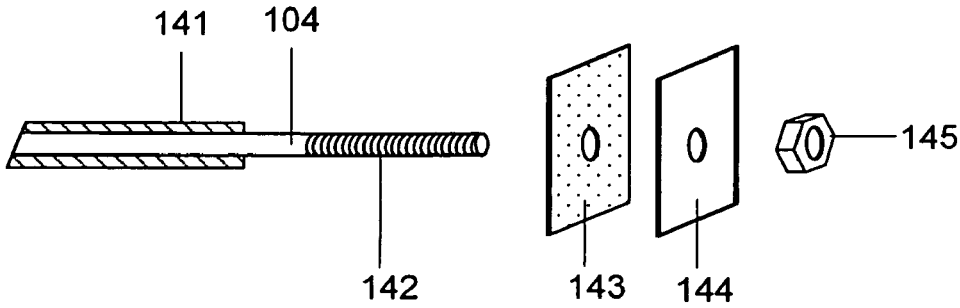
FIG. 14 is a perspective detail of an end section of one of the bands, in which it is possible to observe the protection casing and the threaded terminal, and opposite is a slip-proof plate, a metal plate and the corresponding lock nut.

The modules (1) corresponding to each floor are connected by means of horizontal bands (104) placed between the modules (1) of the successive floors of the building. These horizontal bands (104) can be composed of a threaded rod or a steel cable with protection casing (141), as shown in FIG. 14. In all cases, they have threaded end terminals (142) to assemble a plate (143) in slip-proof material such as neoprene, a metal plate (144) and the corresponding lock nut (145).

By tightening the end nuts (145), the modules (1) of the same floor are subject to horizontal compression, which produces a packaging effect on them.

To build the successive floors, the same operation is repeated, placing another row of modules and the corresponding horizontal compression bands (104), so that the placed modules are stable during all construction phases of the building.

Figure 13:
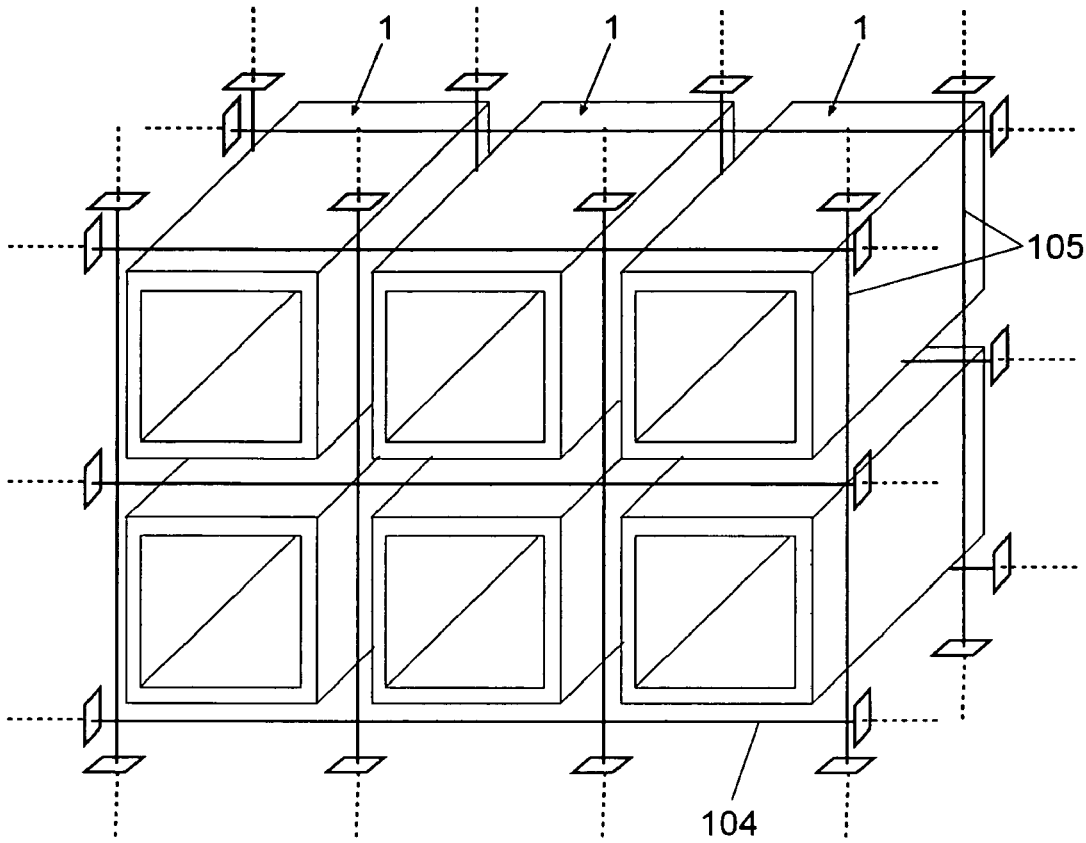
FIG. 13 is the same view as above, but with vertical bands.

As can be observed in FIG. 13, once the required height has been reached, the vertically stacked modules (1) are subject to vertical compression by means of vertical bands (105), which are the same as the horizontal bands (104), that is that they are provided with threaded terminals of the corresponding end compression plates and lock nuts.

In this case, the lower plates of the bands (105) are preferably anchored to the foundations of the building.

The bands (104 and 105) therefore form a mesh or latticework, which sets both the compression of the modules (1) in a horizontal direction and a vertical direction, giving the building a high monolithic level, so that it is possible to widely exceed the three storeys currently recommended in modular buildings.

Figure 15:
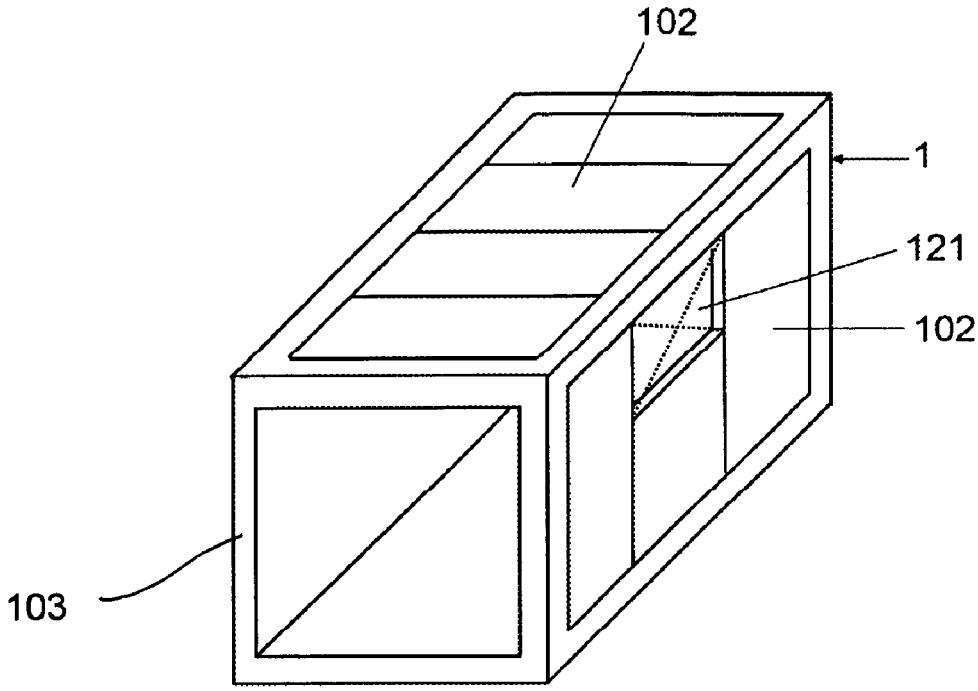
FIGS. 15, 16 and 17 are manufacturing examples of the building modules provided respectively with a side opening for a window, an upper opening for a staircase and a side opening for a balcony.
Figure 16:
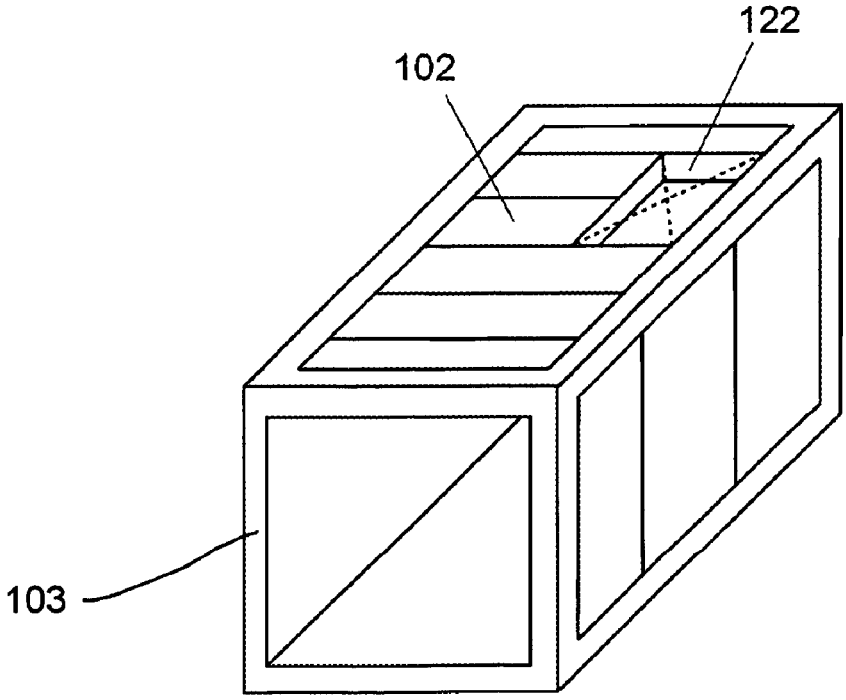
Figure 17:
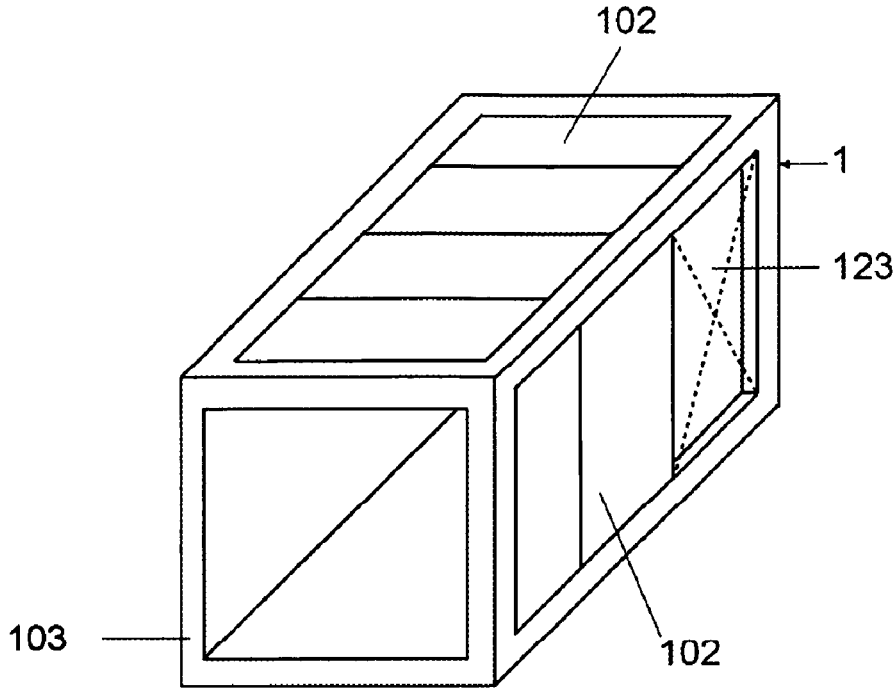

As can be observed in FIGS. 15, 16 and 17, the prefabricated concrete panels (102) can have different openings. FIG. 15 shows a side opening (121) to fit a window, FIG. 16 shows an upper opening (122) for a staircase, and FIG. 17 a side opening for a balcony or similar.

Figure 18:
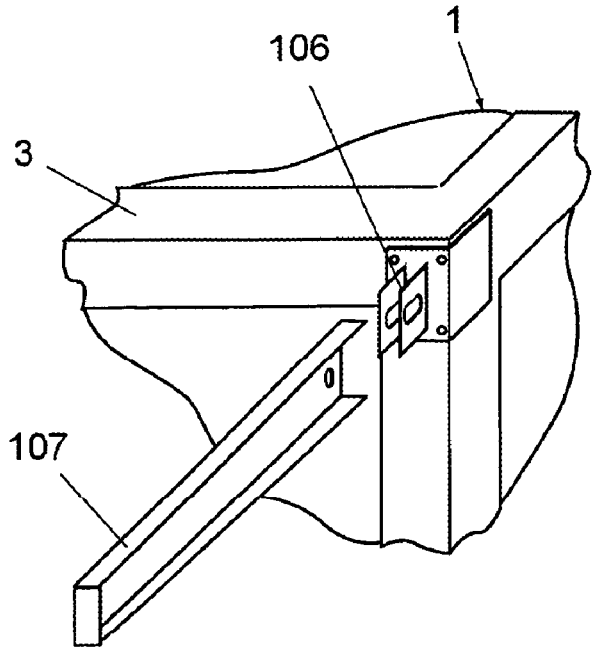
FIG. 18 is a perspective view of one of the corners of a building module provided with a fastening to couple a metal part used to cantilever a rigid plate.

As can be observed in FIG. 18, the modules (1) can also have exterior fastenings (106) to fasten auxiliary metal structures or brackets (107) to cantilever rigid plates on the outside, such as the shaping of balconies or outdoor terraces.

Figure 19:
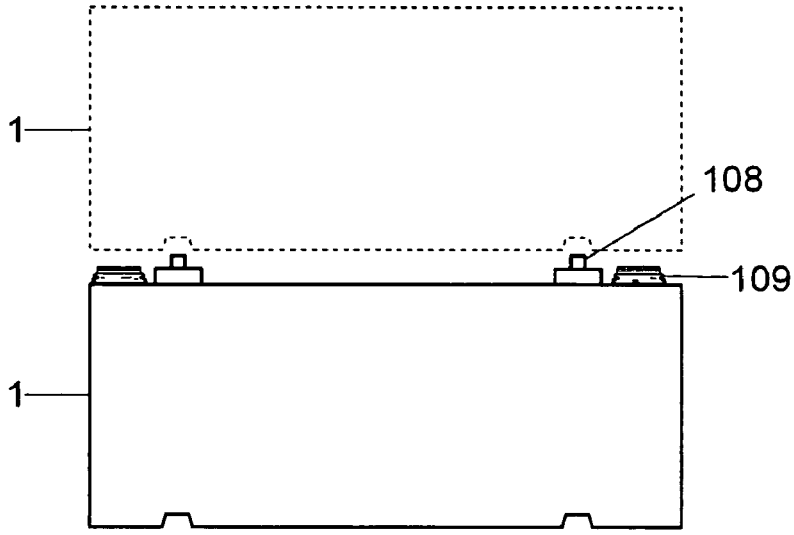
FIGS. 19, 20, 21 and 22 are schematic drawings of successive phases of the assembly method of an upper prefabricated module on a lower prefabricated module, following the method of this invention.

As shown in FIG. 19, the method of this invention initially includes placing hydraulic jacks (108) on a lower prefabricated module (1). These jacks are connected to a hydraulic control system (181) by means of hoses (182) and inflatable tubular sections (109) in flexible material, preferably neoprene, which connect to a non-retraction mortar injection device (191) by means of hoses (192).

Figure 20:
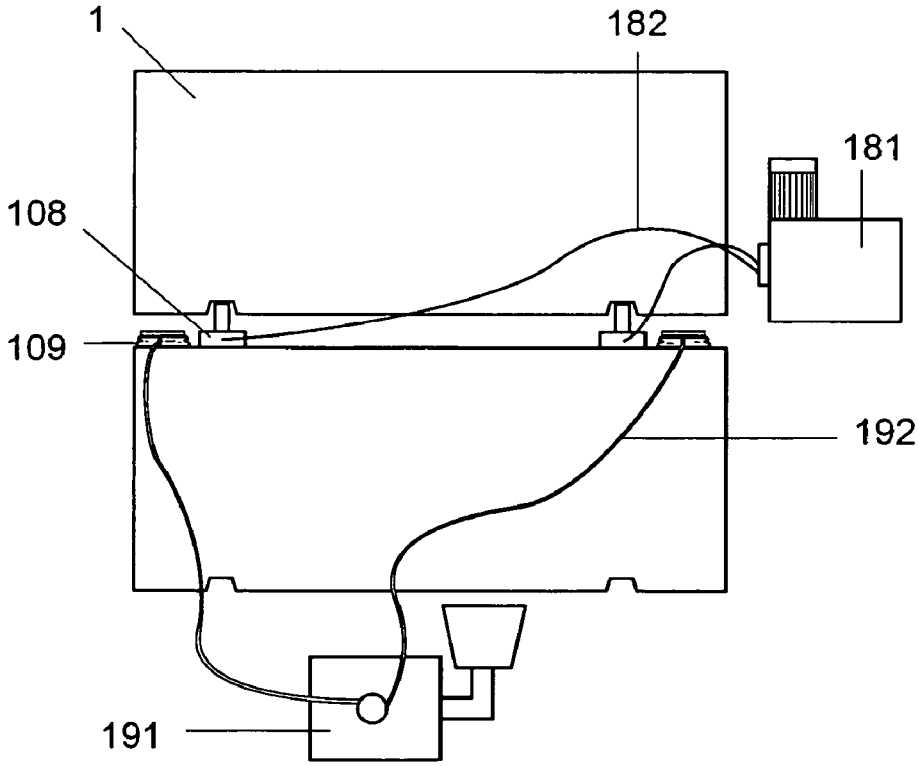
Figure 21:
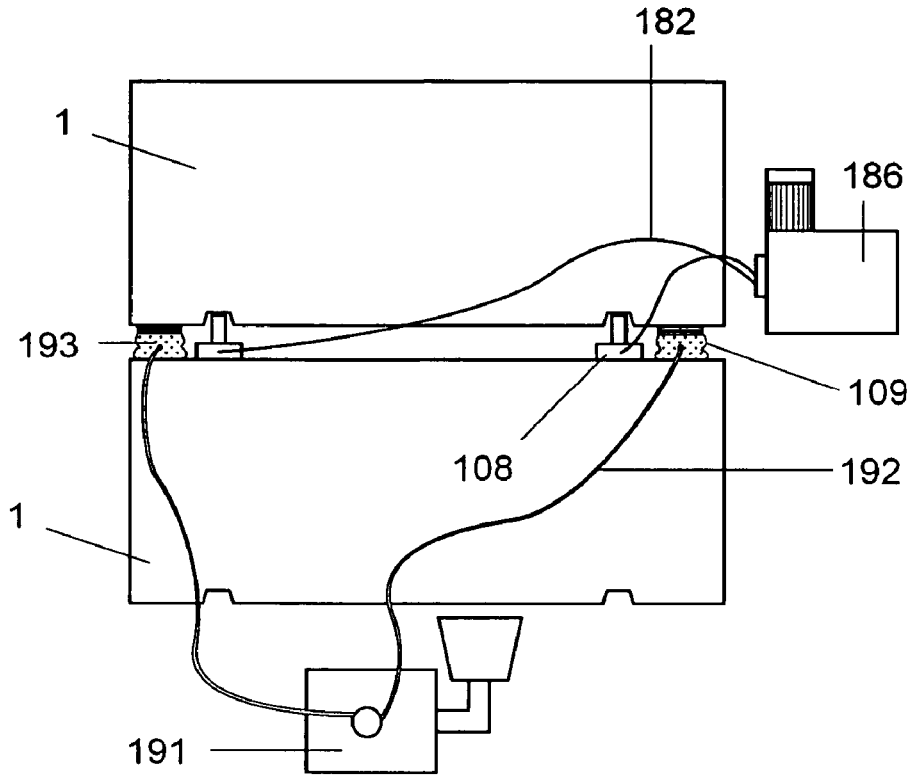

This injection device includes in the example given in FIG. 20, a mortar container hopper and a pump motor to drive the mortar inside the tubular sections (109).

Figure 23:
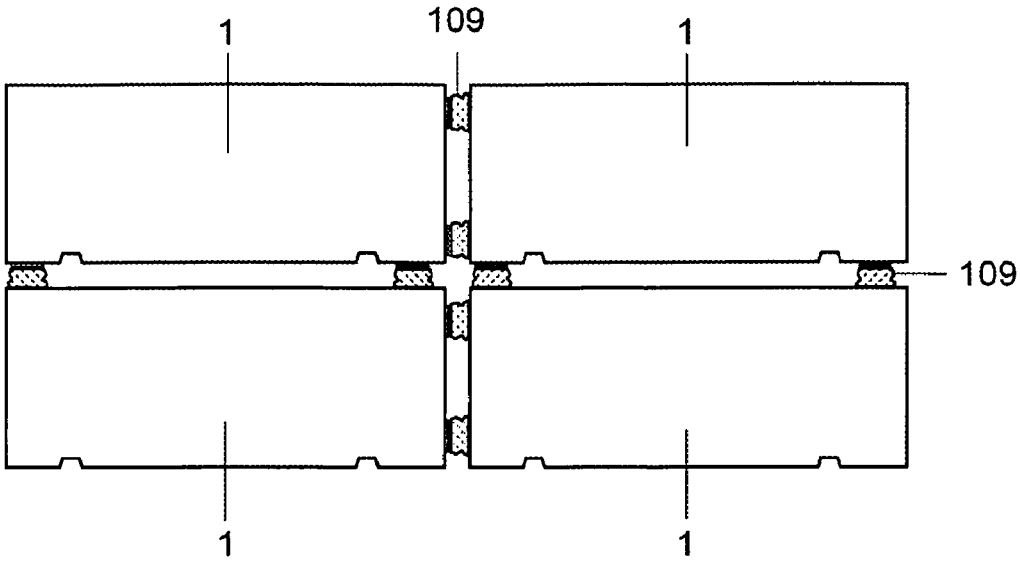
FIG. 23 is an elevation view of a building made using the invention method.

As shown in FIG. 20, the upper module then rests on the hydraulic jacks (108), and the upper prefabricated module is levelled and placed at a certain height, so that the upper module is aligned with another side module of the same floor, as shown in FIG. 23.

Once the upper prefabricated module (1) is levelled, the section (109) are inflated or filled by injecting non-retraction mortar (193) inside the sections (109) so that the two-stacked modules (1) are in contact, filling the space between them and any possible irregularities.

Figure 22:
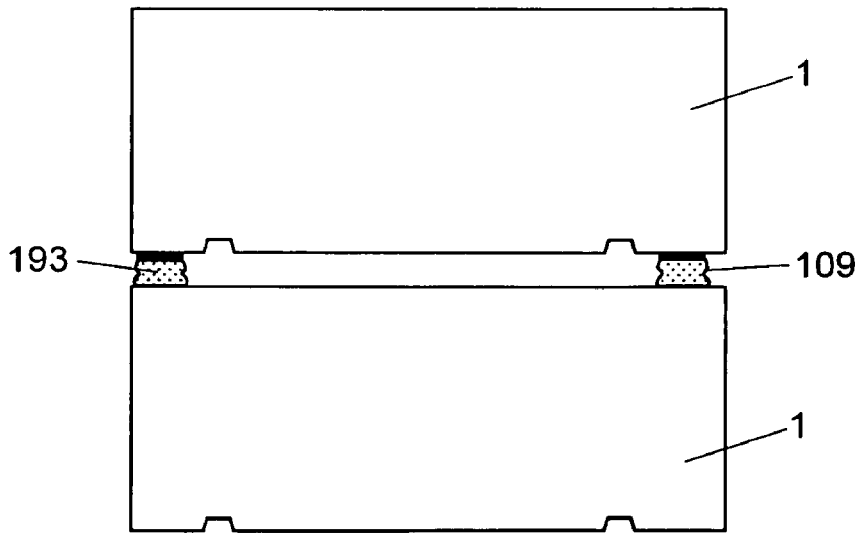

Once the mortar (193) used to fill the sections (109) has set, the hydraulic jacks (108) are removed as shown in FIG. 22, transmitting the loads of the upper module to the lower module evenly through the sections (109) containing the set cement (193).

As shown in FIG. 23, the sections (109) inflated or filled with mortar can be used both as load transmitting elements between the vertically stacked modules (1) or between the adjacent horizontal modules (1).

Figure 24:
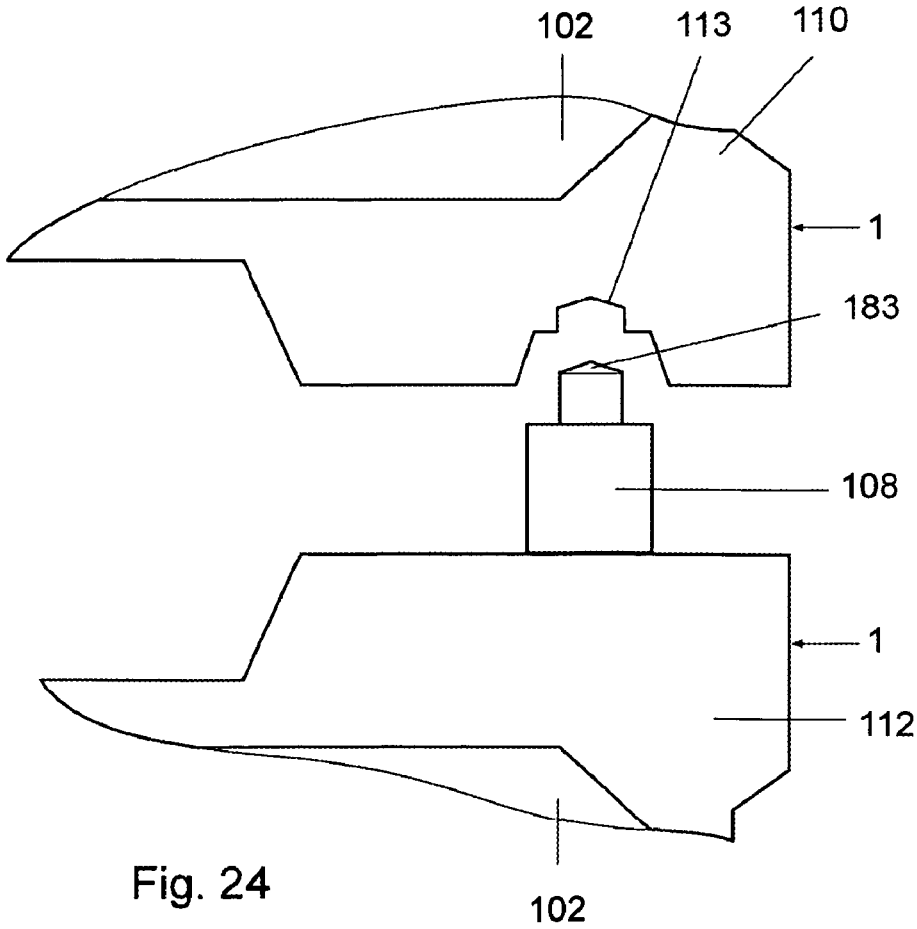
FIG. 24 shows details of two vertically aligned modules, where one of the conical bases to rest on the corresponding hydraulic jack can be observed in the upper module.

As we have mentioned previously, the modules (1) will be formed by at least four prefabricated panels in high resistance concrete, two of them placed vertically, forming the load bearing walls, and the other two horizontally, forming the upper and lower surfaces of the module. These concrete panels (102) are finished with a perimeter steel frame (103). As can be observed in FIG. 24, it has been foreseen that the perimeter frame (103), has conical bases (113), at least on the lower surface of the module (1), to rest on a conical point (183) of the moveable piston of the hydraulic jack (108).

The housing of the conical point (183) of the hydraulic jacks (108) in the conical bases (113) of the upper module, gives greater stability when resting the upper module on the hydraulic jacks (108), particularly bearing in mind that each of these modules (1) may weigh around 40000 kg. and is suspended from a crane while it is positioned on the hydraulic jacks (108). This coupling avoids moving the upper module sideways while resting on the hydraulic jacks (108).

Having described the nature of the invention in sufficient detail, together with an example of preferential manufacture, we would like to indicate that the materials, shape, size and position of the elements described can be modified, as long as this does not alter the essential characteristics of the invention, the claims to which are made below.

The invention claimed is:

1. A modular building system, comprising reinforced building modules (1), each of said modules (1) being a monolithic structure, having walls, a ceiling and a floor, said modules (1) are placed side-by-side, and are stacked vertically in the successive floors of the building, each of said modules having transversal reinforcement ribs (11), longitudinal reinforcement ribs (12), upper positioning devices (2) and lower bushings (3), to receive said positioning devices (2) of one of the modules (1) immediately below another of the modules being positioned, wherein said positioning device (2) comprises a cylindrical rod (23) with the upper end in the shape of a cone, which is joined to a flat bar (22) which is assembled and can be longitudinally and transversally adjusted relative to a plate (21) embedded in one of the modules, and which wherein said embedded plate (21) has rails (24) and screws (25) to position and fasten the flat bar (22), which holds the rod (23), said modules further comprising vertical supports (4) which correspond to the position of said transversal reinforcement ribs (11), side connection elements (5 and 6), elevation fasteners (8), projecting fastening buffers (15) on one side of said modules (1) corresponding to the position of spaces (16) on one side of another of said modules and a filling material (9) in a contact area between said buffers (15) and said spaces (16).

2. A modular building system, comprising reinforced building modules (1), each of said modules (1) being a monolithic structure, having walls, a ceiling and a floor, said modules (1) are placed side-by-side, and are stacked vertically in the successive floors of the building, each of said modules having transversal reinforcement ribs (11), longitudinal reinforcement ribs (12), upper positioning devices (2) and lower bushings (3), to receive said positioning devices (2) of one of the modules (1) immediately below another of the modules being positioned, wherein said reception bushing (3) includes a fastening bushing (31) embedded in the module, a lower bushing (32) and elastic filling (33) placed between both bushings (3,32), said modules further comprising vertical supports (4) which correspond to the position of said transversal reinforcement ribs (11), side connection elements (5 and 6), elevation fasteners (8), projecting fastening buffers (15) on one side of said modules (1) corresponding to the position of spaces (16) on one side of another of said modules and a filling material (9) in a contact area between said buffers (15) and said spaces (16).

3. A modular building system, comprising reinforced building modules (1), each of said modules (1) being a monolithic structure, having walls, a ceiling and a floor, said modules (1) are placed side-by-side, and are stacked vertically in the successive floors of the building, each of said modules having transversal reinforcement ribs (11), longitudinal reinforcement ribs (12), positioning devices (2 and 3), vertical supports (4) which correspond to the position of said transversal reinforcement ribs (11), side connection elements (5 and 6), wherein said side connection elements consist of embedded plates (5) on the ends of the sides of one of the adjacent modules, and connection plates (6) fastened with screws (51) to the aforementioned embedded plates of the adjacent modules, said connection plates (6) are sufficiently flexible to absorb minor vertical movements between adjacent modules (1), said modules further comprising elevation fasteners (8), projecting fastening buffers (15) on one side of said modules (1) corresponding to the position of spaces (16) on one side of another of said modules and a filling material (9) in a contact area between said buffers (15) and said spaces (16).

4. A system, according to claim 3, wherein said connection plates (6) have holes (61) for screws (51), said holes (61) are covered inside with a layer of elastic material (52*a*) and said holes (61) have mounting holes placed at approximately 90° to absorb assembly errors, and each hole has a surrounding transversal toothed edge (63) to lock a lock washer (52), which also has a toothed surface; and because the connection plates (6) consists of sheets (62) of elastic material blocks it absorbs stress and breaks the acoustic bridge.

5. A system, according to claim 3, wherein said embedded plates (5) have at least one safety pin (63), which projects from and is housed in a hole (64) in each of said plates (6).

* * * * *